US005222824A

United States Patent [19]

Nicoll et al.

[11] Patent Number: 5,222,824

[45] Date of Patent: Jun. 29, 1993

[54] REGULATED INK FLOW CONTROL SYSTEM FOR PEN

[75] Inventors: Roy Nicoll, Winnersh Wokingham; Charles Diossy, Cox Green Maidenhead, both of United Kingdom

[73] Assignee: The Gillette Company, Boston, Mass.

[21] Appl. No.: 820,618

[22] PCT Filed: May 10, 1990

[86] PCT No.: PCT/US90/02636

§ 371 Date: Jan. 14, 1992

§ 102(e) Date: Jan. 14, 1992

[87] PCT Pub. No.: WO90/14964

PCT Pub. Date: Dec. 13, 1990

[30] Foreign Application Priority Data

May 18, 1989 [GB] United Kingdom ..... 8911492

[51] Int. Cl.[5] ..... B43K 5/10; B43K 5/18

[52] U.S. Cl. ..... 401/235; 401/141; 401/224; 401/230; 401/232

[58] Field of Search ..... 401/141, 142, 223, 224, 401/230, 231, 232, 235, 236

[56] References Cited

U.S. PATENT DOCUMENTS

| | | |
|---|---|---|
| 70,453 | 11/1867 | Metten . |
| 881,215 | 3/1908 | Wurdemann . |
| 2,669,970 | 2/1954 | Gordon . |
| 4,347,011 | 8/1982 | Yanagita . |
| 4,547,090 | 10/1985 | Baker et al. . |

FOREIGN PATENT DOCUMENTS

| | | |
|---|---|---|
| 595093 | 6/1959 | Italy . |
| 40228 | 11/1957 | Poland . |
| 722177 | 1/1955 | United Kingdom . |

*Primary Examiner*—Steven A. Bratlie

[57] ABSTRACT

A reservoir pen includes a valve operated by the pen nib (4) to allow ink to pass to the nib, the ink flow rate being controlled by a flow restricting device (8) located between a primary ink reservoir chamber (2) enclosed within the pen barrel (1) and a secondary ink reservoir chamber (6) of much smaller capacity from which an ink channel (10) leads to the valve. The device (8) is a length of an extruded rod of microporous plastics. The nib is pressed towards the feed bar (3) by one spring element (21) and the valve member (12) which cooperates with a seat defined by the feed bar is urged to its closed position by another spring element (28). The rear end of the primary ink chamber (2) is closed by a grease plug comprising a mass of grease and a skeletal reinforcing frame.

5 Claims, 8 Drawing Sheets

REGULATED INK FLOW CONTROL SYSTEM FOR PEN

This invention relates to writing instruments and more particularly to reservoir pens.

It was been proposed to construct a reservoir pen having a barrel enclosing an ink reservoir, a nib, a feed bar underlying the nib and defining an ink feed channel for supplying ink from the reservoir to the underside of the nib, and a valve for closing the ink feed channel coupled to the nib to be opened thereby upon application of the nib against a surface during writing to allow ink to flow to the nib. The advantage of a valve is that it can prevent the ink drying up in the feed channel during periods of non-use. As far as is known, however, no such pen has been made available on the market, a major reason for which is believed to be due to difficulties of controlling ink flow from the reservoir when the valve is opened. In order to achieve a regulated ink flow the feed channel and/or valve must be made to such close tolerances that it cannot be manufactured economically by present day production methods.

The present invention aims at a solution to the foregoing problem and in accordance with the invention there is provided a pen comprising a primary ink reservoir chamber, a secondary ink reservoir chamber, a nib, an ink feed channel for conducting ink from the secondary ink reservoir chamber to the nib via a nib actuated valve, and flow restricting means for regulating ink flow from the primary to the secondary reservoir chamber and thereby flow of ink to the nib when the valve is opened.

In a pen according to the invention the ink flow rate is conveniently controlled by including suitable flow restricting means within the reservoir structure, whereby the flow regulating duty is taken away from the ink feed channel and/or valve so that the latter becomes a simple on-off valve and the severe tolerancing demands on these components are obviated. The flow restricting means can be any device, member or element capable of allowing ink to flow through or past at a controlled maximum rate. Very satisfactory results have been achieved with an element of microporous material consisting of a length cut off from a extruded plastics rod having capillary channels extending along its length. With such material, which may be the same as that sometimes used as porous writing tips in other writing instruments, the flow resistance can readily be adjusted by taking longer or shorter lengths.

The secondary ink reservoir can be of very substantially smaller capacity than the primary chamber where nearly all of the ink is stored, the secondary chamber being included to ensure a volume of ink immediately available for supply to the valve and hence the nib when the valve is opened.

In conventional fountain pens air must enter the ink reservoir chamber to replace the ink as it is used up. Expansion of the air within the reservoir due to changes in temperature and/or ambient pressure (e.g. when carried on an aeroplane) can cause ink to be expelled. This disadvantage is avoided in the pen described in the present specification by virtue of the fact that the primary reservoir chamber is made so that it reduces in volume as the ink is used. This means that the need for air to enter the reservoir is precluded and the reservoir system remains a closed ink-filled system. The reducible volume reservoir may take different forms, such a flaccid sack, but in a preferred embodiment comprises a cylindrical body and a grease plug which slides along the body following the ink as it is used up.

In accordance with a novel feature of the invention the grease plug incorporates a reinforcement frame of rigid material. The frame which consists of a skeletal structure defining a large contact area for the grease and dimensioned to fit freely within the reservoir body so that a layer of grease is always present between them has been found to help maintain the integrity of the grease mass, especially when large diameter reservoir bodies are concerned. The frame can also serve to limit contact between the grease and atomsphere air which can lead to oxidation and drying out of the grease whereby the performance of the grease plug is impaired. In one particular construction the frame comprises a plurality of radial fins e.g. 3 to 6 in number, and a transverse disc at the trailing end of the fins and possibly apertured to facilitate insertion of the frame into the grease.

The reinforcement frame means that a large diameter body and hence large volume chamber are feasible and the body may be constituted by the pen barrel itself. It even becomes commercially acceptable for the pen to be of the so-called disposable type intended to be discarded when the reservoir has been emptied of ink.

Also provided by the invention is a novel valve structure for the pen. The valve seat is formed in the feed bar underlying the nib and surrounding the ink feed channel opening. The valve member is made of a material softer than that of the seat to ensure good sealing engagement, and is shaped to define with the seat an ink duct which decreases in width in the downstream direction so that flow of ink through the opened valve is assisted by capillary attraction. In addition, the valve member includes a part which projects into the ink feed channel and serves to draw ink through the channel as the valve is opened to aid the initial supply of ink to the writing tip of the nib. The valve member conveniently takes the form of a plug which passes through a hole in the nib and is urged to a closed position by a spring member acting on its outer end. Movement of the nib under normal writing pressure causes it to lift the valve plug to open the valve, the movement of the nib being limited by stop means provided thereon engaging an abutment on the feed bar.

The above and other preferred features of the invention are described in more detail below in connection with some specific embodiments and with reference to the accompanying drawings, in which.

Figure 14:
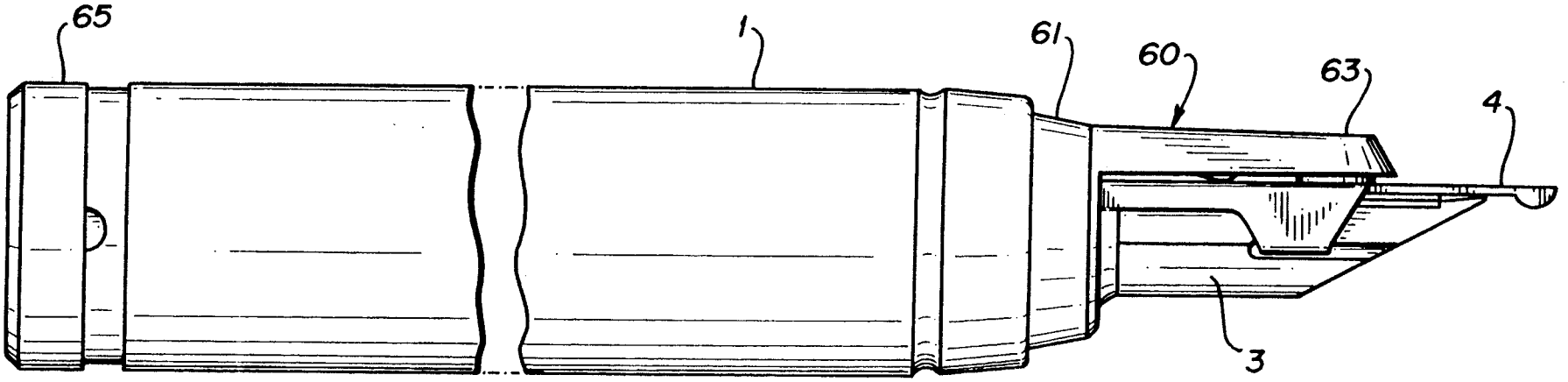
Figure 15:
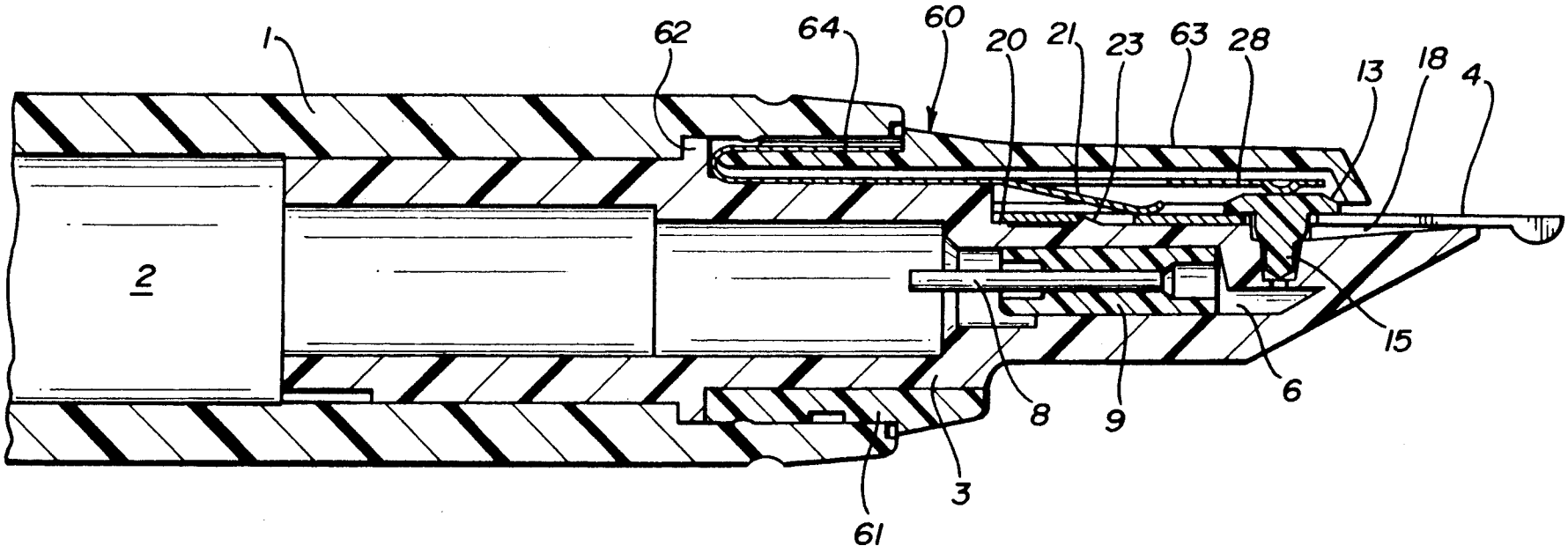
Figure 16:
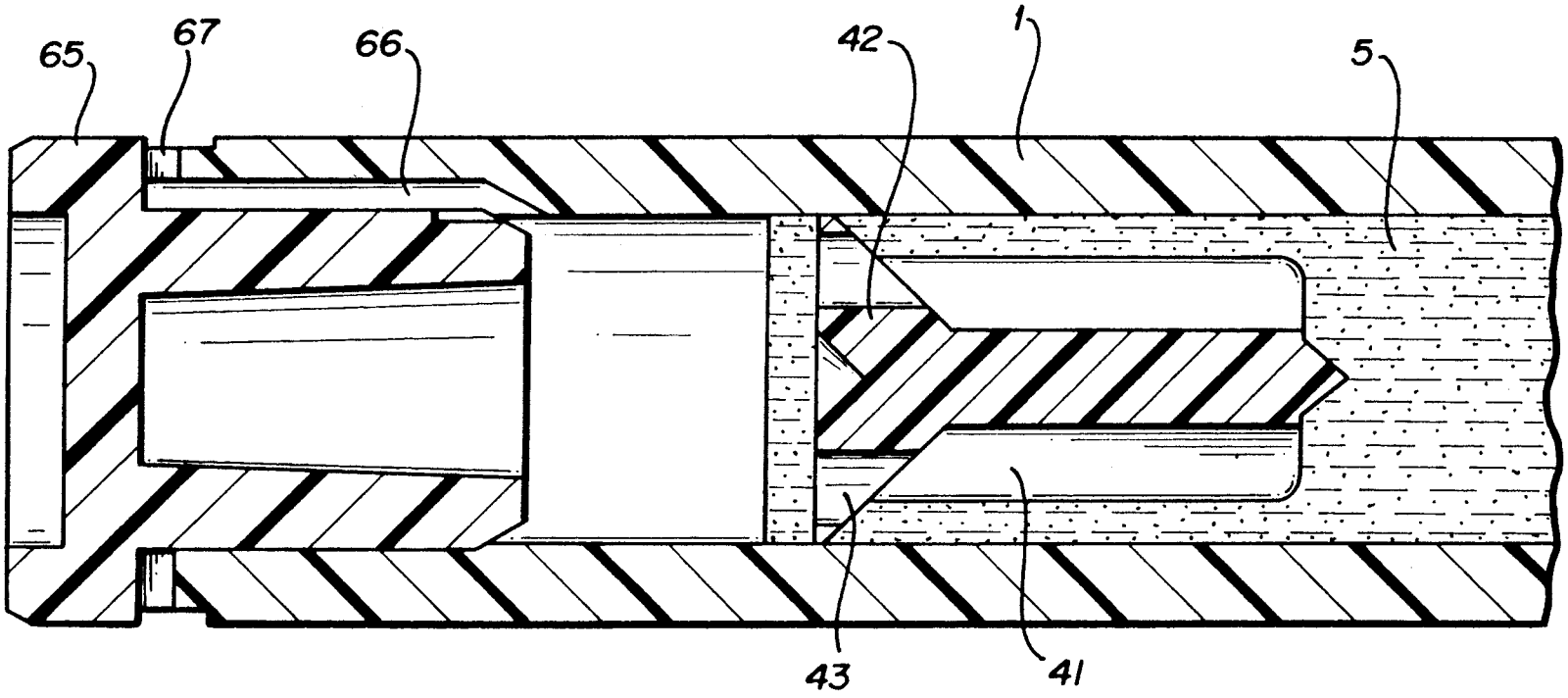

FIGS. 10 to 13 correspond to FIGS. 6 to 10 respectively and show an alternative construction for the grease plug frame;

FIG. 14 is a side view of a modified embodiment of the invention;

FIG. 15 is an axial cross-section through the forward end part of the pen of FIG. 14; and FIG. 16 is an axial cross-section through a rear end part of the pen of FIG. 14.

The pen illustrated in FIGS. 1 to 9 of the drawings is intended to be discarded after the initial ink charge has been completely depleted. It comprises a tubular barrel 1 which also serves to define a primary reservoir chamber 2 as will become clear, a feed bar 3 fitted to the forward end of the barrel 1 and mounting the pen nib 4, and a grease plug 5 received in the rear end of the barrel immediately behind the column of ink stored in the chamber 2.

The feed bar has an axial bore which is stepped to define three main sections, namely a rear section of large diameter which defines a portion of the primary reservoir chamber, an intermediate section, and a forward section which constitutes a secondary ink reservoir chamber 6. Accommodated in the intermediate bore section and separating the primary and secondary reservoir chambers is a flow restrictor device consisting of an extruded rod 8 of plastics having one or more capillaries extending longitudinally through the rod, and a tubular holder 9 for supporting the rod in the feed bar so that the ink is constrained to flow through the restrictor in passing from the primary to the secondary reservoir chamber. The flow resistance produced by the restrictor is determined by the length of the rod 8 and can therefore be adjusted by using longer or shorter lengths of rod. The capacity of chamber 6 can be very small and is very much less than that of the primary chamber 2.

An ink feed channel 10 leads from the secondary reservoir chamber to the upper side of the feed bar, and an annular valve seat 11 extends around the channel for cooperation with a valve member 12 formed by a plug 13. The plug extends through a hole provided in the nib 4 and has an enlarged head 14 which overlies the nib so that movement of the nib away from the feed bar due to the writing point of the nib being pressed down on a sheet of paper during writing causes the plug 13 to be lifted and the valve member 12 to be raised from the valve seat 11 to allow ink to flow out through the feed channel 10. To encourage the initial ink flow the inner end of the plug is shaped as a piston 15 which acts to draw the ink out of the feed channel with a pump-like action as the plug 13 is lifted. To encourage the ink flow further the domed valve member cooperates with a part-spherical socket formed in the feed bar downstream of the valve seat to define an annular ink duct or channel 16 (FIG. 5) which narrows in width away from the seat so that the capillary forces tend to draw the ink out from the ink feed channel.

The feed bar 3, and hence the valve seat are formed of relatively hard material, such as polycarbonate and the plug 13 is made of a softer material, e.g. high density polyethylene, so that a good seal will be obtained between the valve member and seat despite any surface irregularities.

Figure 4:
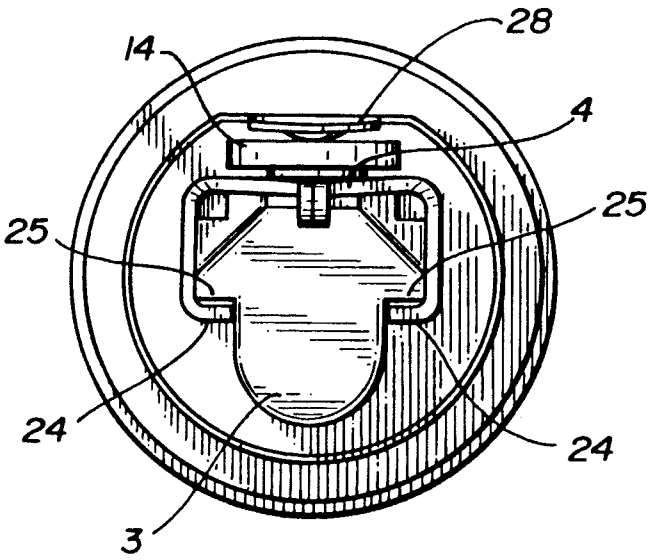
FIG. 4 is a front end view of the assembly shown in FIG. 2.
Figure 5:
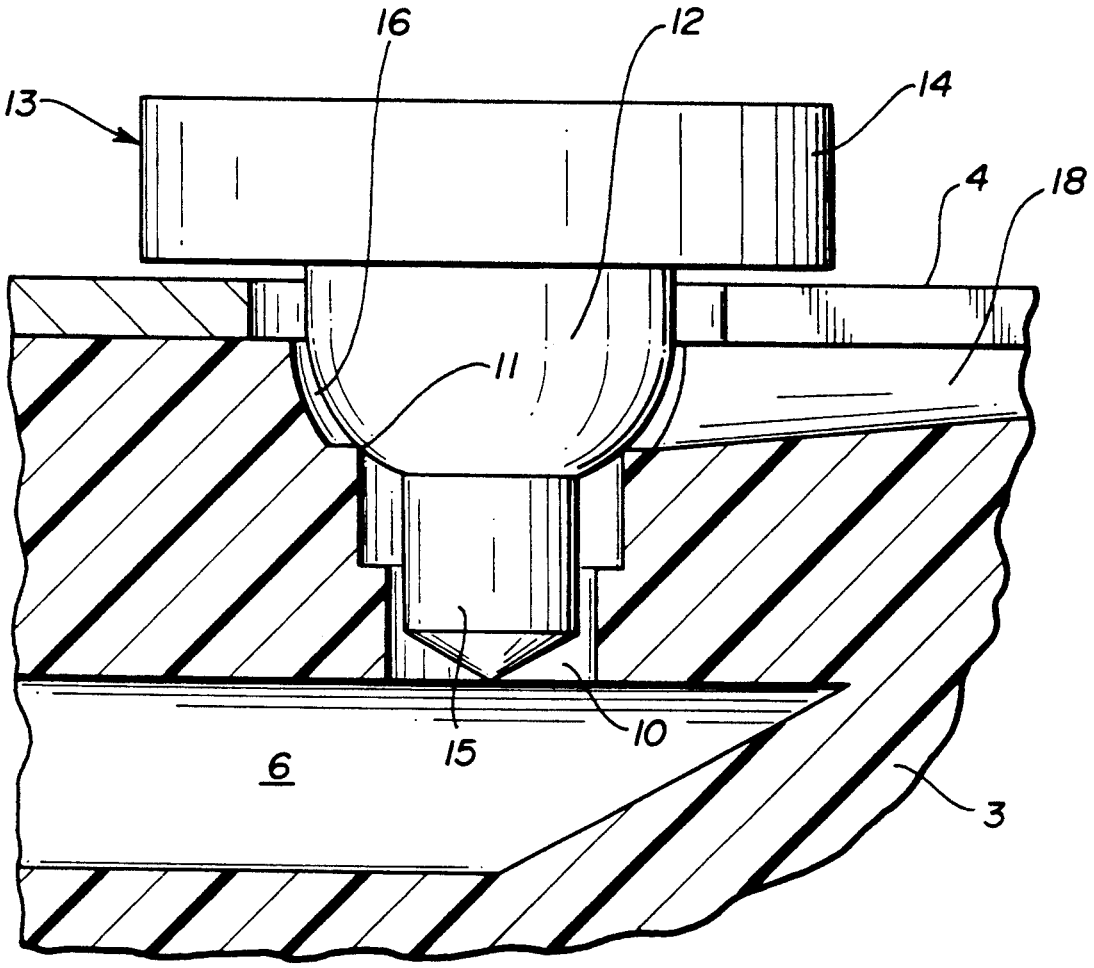
FIG. 5 is a detailed cross-section of the valve.
Figure 6:
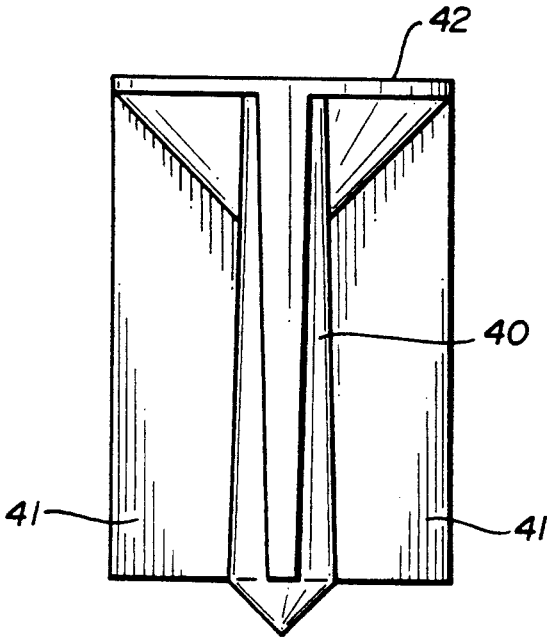
FIG. 6 is a side elevation of the grease plug frame.
Figure 7:
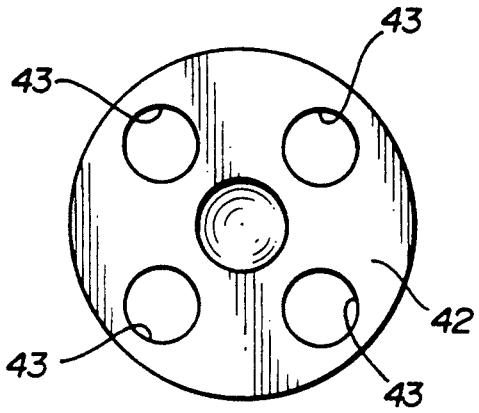
FIG. 7 is a top plan of the grease plug frame.
Figure 8:
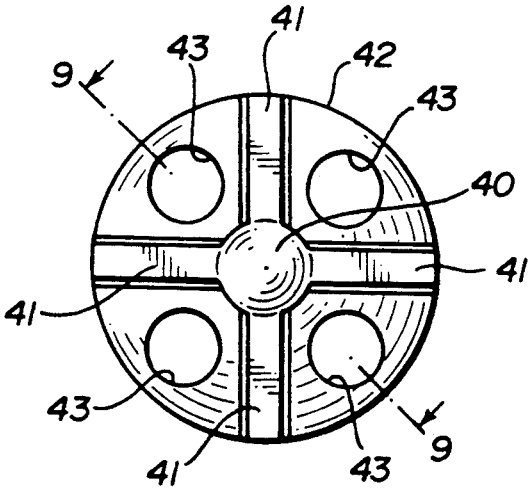
FIG. 8 is a bottom plan of the grease plug frame.
Figure 9:
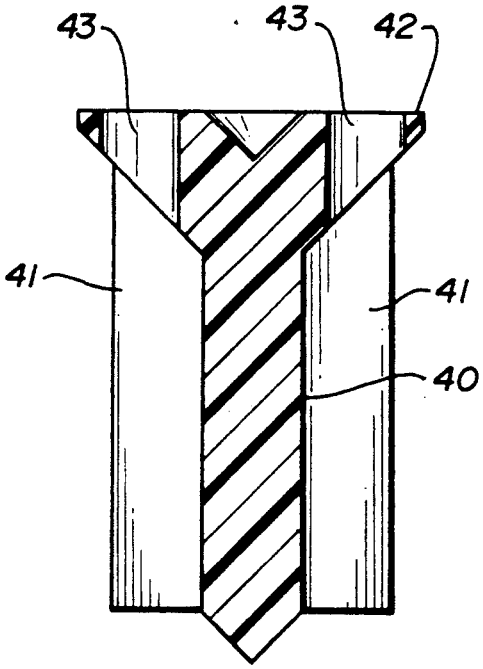
FIG. 9 is a section taken along the line A—A in FIG. 8.

The outer surface of the feed bar is provided with a longitudinal groove 18 extending from the socket towards the free end of the feed bar, this groove tapering in depth and width to define a capillary aiding flow of ink to the writing tip of the nib 4. The nib is slit from its tip to the hole in which the plug 13 is inserted, the slit forming the final part of the ink flow path to the writing tip. The rear end of the nib is supported on a slightly raised shoulder 20 formed on the feed bar and the nib also rests against the feed bar at the forward end of the latter under the influence of a leaf spring 21. Thus, there is defined between the nib and feed bar a gap which tapers forwardly to encourage by capillary action flow of ink in that direction. For retaining the nib in position the feed bar is formed with a latching projection 23 which engages in a hole 24 in the nib. At a rear end portion of the nib, the sides of the nib are bent to define L-shaped extensions providing stops 24 underlying lateral abutment shoulders 25 provided on opposite sides of the feed bar (FIG. 4). The stops 24 engage the shoulders 25 to limit the movement of the nib away from the feed bar to that necessary to open the valve and allow essentially free flow of ink out of the feed channel 10. In this connection it should be mentioned that the valve is not required to regulate the ink flow rate, this function being performed by the rod 8 of the flow restrictor which regulates the flow of ink out of the secondary reservoir chamber by controlling the flow of replacement ink into this chamber from the primary reservoir chamber.

A second leaf spring 28 acts on the head 14 of plug 13 urging the valve member into the closed position. The plug could be fixed to the nib but for ease of manufacturing it is preferred that they should be separate and be acted upon by the respective springs 21, 28. The springs are nonetheless provided by a unitary spring component 30 which includes a mounting collar 32 surrounding the feed bar and from which projects a finger constituting the spring 28, the spring 21 being formed by a central part stamped out of this finger. The collar 32 is notched to receive a location pip 33 to ensure correct rotational positioning of the spring of the feed bar.

The grease plug 5 consists of a mass of grease material and a reinforcing frame or cage which is shown in FIGS. 6 to 9. The cage comprises a central hub 40 with a pointed end and from which project four radial fins 41 spaced uniformly around the hub. At the trailing end there is a circular disc 42 with holes 43 which register with the spaces between the fins 41. After the pen barrel 1 is filled with ink the mass of grease is introduced so that it is in contact with the ink surface. The cage is then inserted into the grease so that the disc 42 covers its outer surface, or so that the cage is completely embedded in the grease. The holes 43 facilitate the insertion by allowing trapped air to escape. The outer diameter of the cage is less than the inner diameter of the barrel, preferably by an amount to allow a grease layer at least in the order of 0.1 mm thick between them. Furthermore, to resist breakup of the grease plug it is preferable for there to be a solid mass of grease extending at least about 5 mm forwardly from the front end of the reinforcing cage.

As the ink in the primary reservoir chamber 2 is used up, the grease plug slides forward along the barrel maintaining contact with the ink. The cage reduces the shear forces within the mass of grease, by confining the shearing forces to a thin layer of grease adjacent the reservoir wall, so that the integrity of the grease mass remains intact despite the large diameter of the barrel and the low viscosity of the aqueous ink which may be used in the pen. If the disc 42 of the cage is positioned to cover the surface of the grease it reduces contact with atmosphere so that hardening or softening of the grease due to drying out and oxidation, which can have deleterious effects on the ability of the grease to follow the ink movement, are essentially precluded. The area of contact is mainly confined to the holes 43 and in extreme cases these could be filled in after insertion of the cage into the grease.

The necessity for the ink in the primary chamber 2 to pull the grease plug along behind as it flows out of the pen means that the grease plug itself has some restricting effect on the ink flow rate. The flow restrictor can be arranged to make allowance for that resistance so that the required flow rate is obtained.

Figure 10:
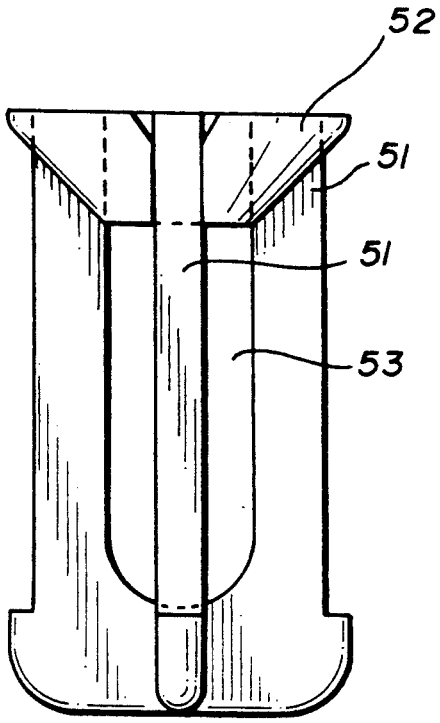
Figure 11:
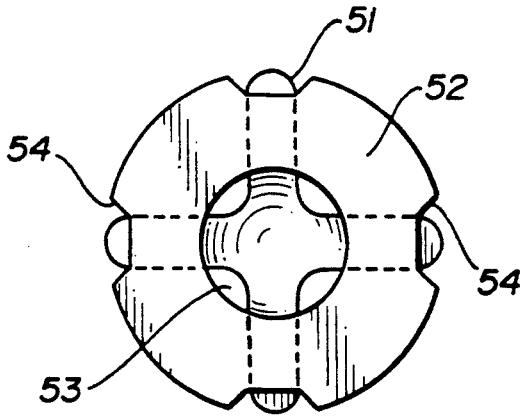
Figure 12:
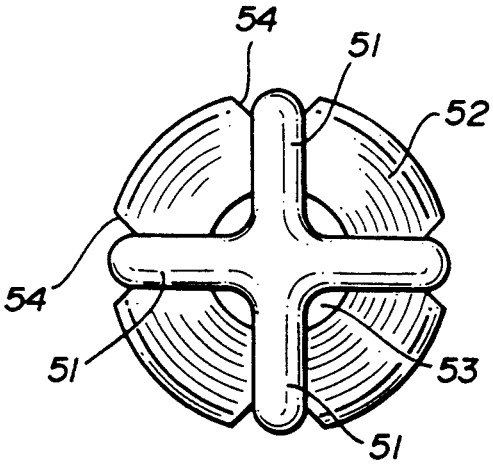
Figure 13:
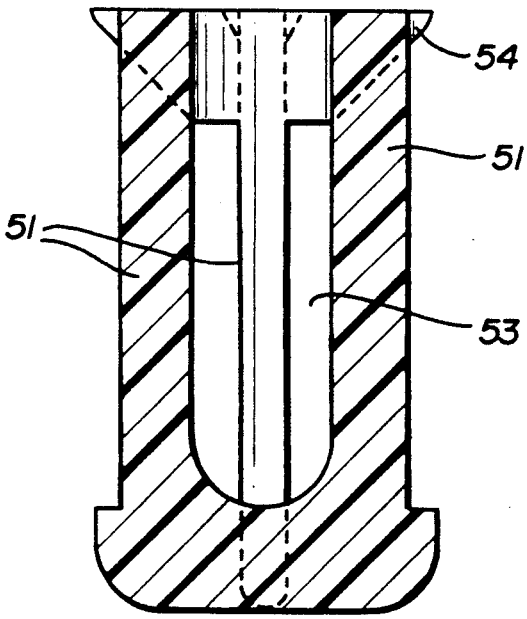

An alternative form of grease plug reinforcing cage is illustrated in FIGS. 10–12. It is generally similar in form to the cage of FIGS. 6–9 in that it is a unitary member including four uniformly spaced radial fins 51 and a circular disc 52 at the upper end. The cage has a central bore 53 extending through the disc 52, thereby to serve the same purpose of the holes 43 in the first embodiment, and extending along the fins but terminating short of their free lower ends. The bore is of sufficient diameter that it provides direct communication between the inter-fin spaces, which helps to maintain the integrity of the grease plug due to the grease segments filling said spaces being directly connected through the cage. The lower end corners of the fine are radiused to assist in guiding the cage along the reservoir body, and also to encourage bubbles of air to pass out between the grease plug and the reservoir. Also to encourage the passage of air bubbles and minimise friction the fins are reduced in radial width above their lower end portions. The disc 52 is formed with notches 54 in alignment with the fins to prolong the air escape path past the disc. The function and use of the grease cage are the same as described above with respect to FIGS. 6–9.

A second embodiment of a pen according to the invention is shown in FIGS. 14–16. For the most part the pen is essentially the same as that of FIGS. 1–5, and the same reference numerals have been used to denote corresponding parts in the drawings of the respective embodiments. The main difference at the forward or writing end of the pen is the addition of a shroud member 60 which serves to lock the spring component 30 in place on the feed bar 3, and which also acts to conceal the springs 21, 28 and the valve plug 13 whereby they are protected against damage and the overall appearance of the writing tip is enhanced. The shroud member includes a collar 61 which engages with a snap fit in the forward end of the pen barrel 1. The collar also abuts against a flange 62 on the feed bar to hold it against an internal shoulder formed in the barrel, thereby securing the feed bar in the barrel. An integral finger portion 63 of the shroud member projects forwardly from the collar 61 and covers the springs 21, 28 and valve plug 13. Rather than having a mounting collar 32 as in the first embodiment, the spring component 30 has a tail 64 bent around the rear edge of the shroud member and located in a longitudinal groove provided in the outer surface of its collar 61. Thus, the spring tail 64 is captured and held firmly between the shroud member 60 and the barrel 1, so that the spring component is anchored securely in position.

Figure 1:
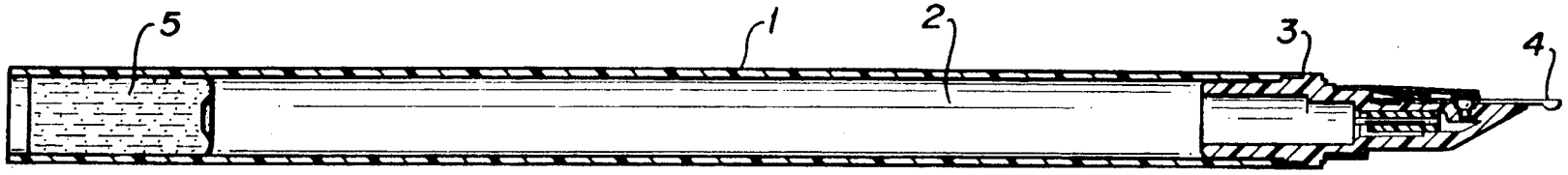
FIG. 1 is an axial cross-section through a pen constructed in accordance with the invention.
Figure 2:
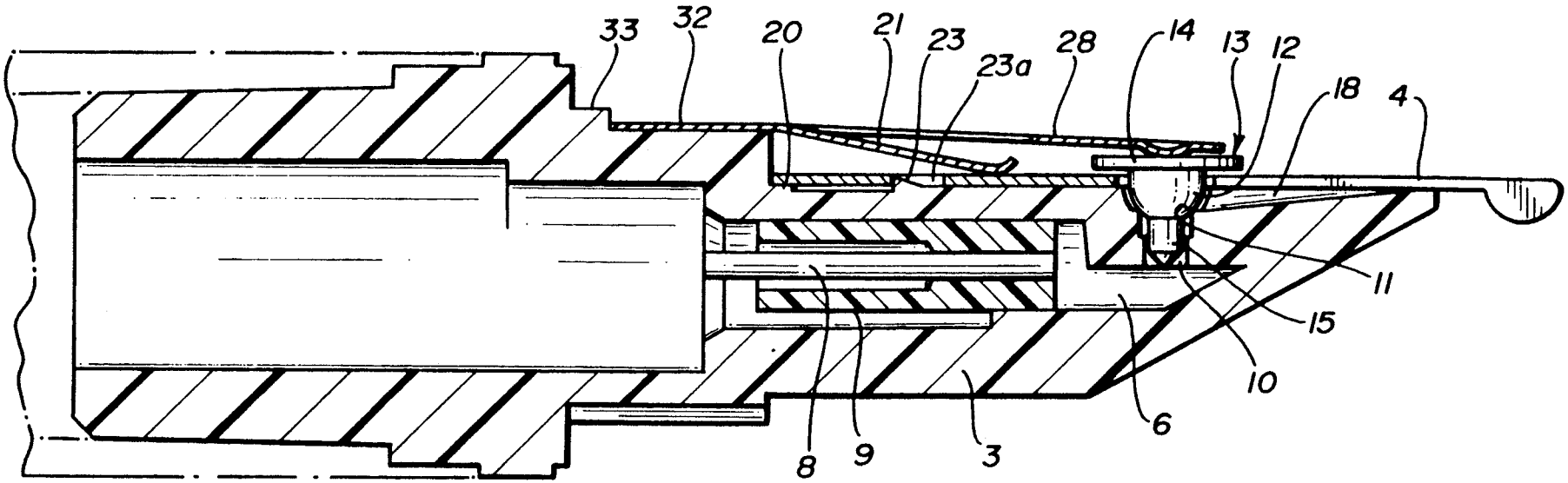
FIG. 2 is an enlarged cross-section of the feed bar and nib assembly.
Figure 3:
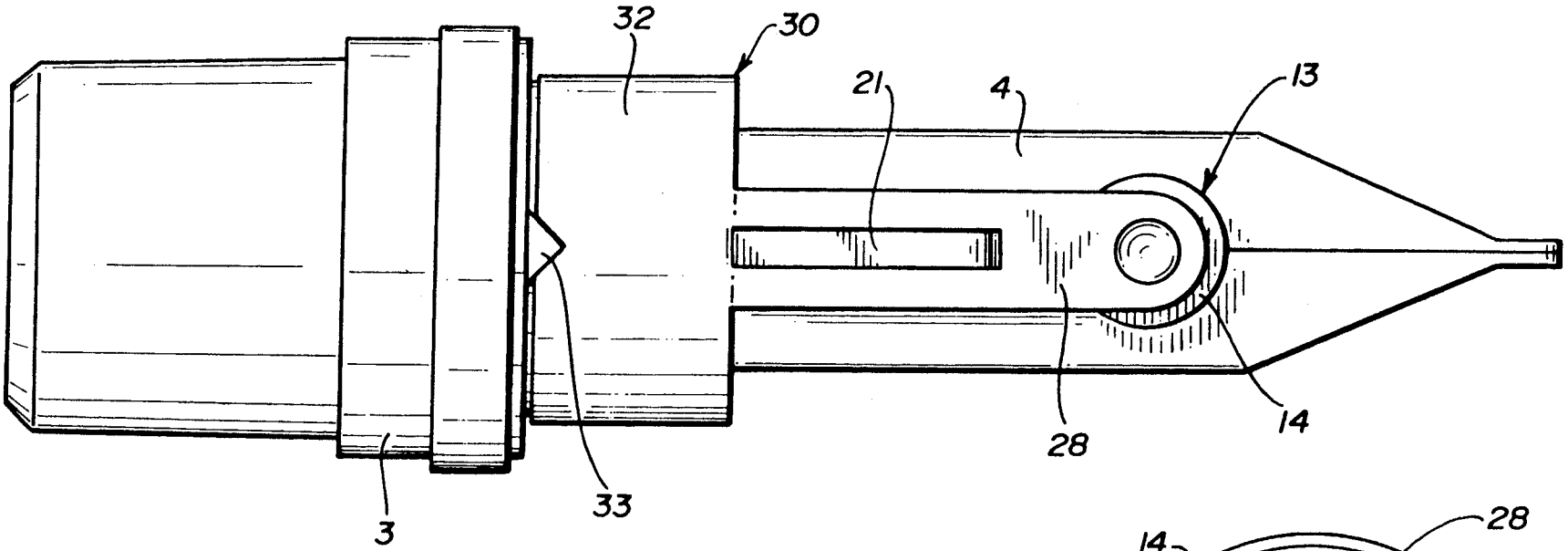
FIG. 3 is a plan view of the assembly shown in FIG. 2.

Turning attention now to the rear end of the pen, it is preferable for the end of the barrel not to be left entirely open as in FIG. 1. In the pen of FIGS. 14–16 the rear end of the barrel 1 is equipped with a closure member in the form of a plug 65 pushed with a tight fit into the end of the barrel. Steps need to be taken to avoid a vacuum being created behind the grease plug 5 as it is moved forwardly due to the ink in the reservoir being used up, since a vacuum would oppose such movement and possibly lead to disintegration of the grease plug. For this purpose an air vent is provided and is formed by a longitudinal groove 66 extending along the inside of the barrel 1 and a notch 67 in the end of the barrel which defines an air port with the plug 65. As shown in FIG. 16, the cage reinforcing the grease plug 5 is completely embedded in the grease. The fact that there is only restricted communication with ambient atmosphere through the narrow vent passage means contact of air with the grease is minimal and hence its adverse affects on the grease are diminished to acceptable levels. It will be appreciated that the feed bar 3 and shroud member 60, with the other pen parts carried thereby, will be assembled with the barrel 1 following which the primary reservoir 2 will be filled with ink, the grease plug 5 and its stabilising cage will be introduced, and finally the plug 65 will be fitted. The pen is intended to be discarded when all the ink has been consumed. Of course, the pen could alternatively be arranged to accept ink cartridges or to be otherwise refillable, but if it is to be filled through the writing end steps would need to be taken to bypass the valve (or to ensure it was open) and bypass the flow restrictor 8 to allow ink to flow into the main reservoir chamber 2 at an acceptable rate during filling operations.

We claim:

1. A pen characterized by a primary ink reservoir chamber, a secondary ink reservoir chamber, a nib, an ink feed channel for conducting ink from the secondary ink reservoir chamber to the nib via a nib actuated valve, and flow restricting means for regulating ink flow from the primary to the secondary reservoir chamber and thereby flow of ink to the nib when the valve is opened, said valve having a seat defined by the feed bar and a valve member biased against the seat by spring means, the lower end of said valve member shaped as a piston extending downwardly into the feed channel below the valve seat, said piston acting to draw the ink out of the feed channel with a pump-like action as the valve member is lifted from the seat.

2. A pen according to claim 1, characterized in that the ink feed channel is defined in a feed bar underlying the nib.

3. A pen according to claim 2, characterized in that the secondary ink chamber is defined in the feed bar.

4. A pen according to claim 1, characterized in that the flow restricting means comprises an element of microporous material.

5. A pen according to claim 4, characterized in that the flow restricting means is an elongate element supported in the feed bar by a holder isolating the secondary ink chamber from the primary ink chamber.

* * * * *